US005331526A

United States Patent [19]

Girot et al.

[11] Patent Number: 5,331,526

[45] Date of Patent: Jul. 19, 1994

[54] DEVICE FOR LIGHTING AND SUSPENSION OF A HANGING-ROD AND MODULAR ASSEMBLY FOR LIGHTING AND SUSPENSION OF HANGING-RODS

[75] Inventors: Alain Girot; Bruno Houssin; Pierre-Laurent Martin, all of Paris, France

[73] Assignee: Zebulon, Paris, France

[21] Appl. No.: 51

[22] Filed: Jan. 4, 1993

[30] Foreign Application Priority Data

Jan. 8, 1992 [FR] France ..... 92 00108

[51] Int. Cl.[5] ..... F21S 1/02

[52] U.S. Cl. ..... 362/147; 362/151; 362/432

[58] Field of Search ..... 362/74, 147, 432, 151

[56] References Cited

U.S. PATENT DOCUMENTS

| | | | |
|---|---|---|---|
| 2,922,029 | 1/1960 | Eschelbach et al. | 362/151 |
| 4,246,629 | 1/1981 | Marrero | 362/147 |
| 4,251,855 | 2/1981 | Radek | 362/432 |
| 4,415,957 | 11/1983 | Schwartz | 362/147 |
| 4,725,931 | 2/1988 | Bourdon | 362/151 |
| 4,994,943 | 2/1991 | Aspenwall | 362/432 |

FOREIGN PATENT DOCUMENTS

| | | | |
|---|---|---|---|
| 0324466 | 7/1989 | . | |
| 3611215 | 2/1988 | Fed. Rep. of Germany | 362/147 |
| 3836979 | 5/1990 | Fed. Rep. of Germany | . |

*Primary Examiner*—Louis J. Casaregola
*Assistant Examiner*—Michael I. Kocharov
*Attorney, Agent, or Firm*—Felfe & Lynch

[57] ABSTRACT

The invention relates to a device for lighting and suspension of at least one hanging-rod (9), characterized in that it comprises a mounting member (1) adapted to be fixed against a wall (2) or a ceiling and at least a first sectional member constituting a cornice (3) having in cross-section a vertical portion (4) which forms at the upper end a cavity (5) for hooking onto said mounting member (1) and at the lower end a nose (6) for receiving the raised end (7) of a support (8) which may be provided for a hanging-rod and for horizontal stabilization by means of a couple exerted between said mounting member (1) and said hanging-rod support (8), and a portion (10) having a horizontal tendency and of concave shape towards said upper end of the vertical portion (4) and provided with first means for supplying electric current to at least a first light source (38), a proximal extremity (13) of said horizontal-tendency portion (10) being intended to constitute a vertical bearing surface for said raised end (7) of the hanging-rod support (8).

20 Claims, 4 Drawing Sheets

DEVICE FOR LIGHTING AND SUSPENSION OF A HANGING-ROD AND MODULAR ASSEMBLY FOR LIGHTING AND SUSPENSION OF HANGING-RODS

BACKGROUND OF THE INVENTION

The present invention relates to a device for lighting and suspension of a hanging-rod, said device being intended to be fixed against a wall or a ceiling.

The object of the invention is to propose a lighting and suspension device which, without calling for any complex structural modifications, permits direct or indirect lighting from a cornice which contributes to the suspension of objects to be illuminated.

Another object of the invention is to permit the use of the device for showrooms such as, for example, art galleries, display windows, exhibition halls, museums and the like by permitting a modular assembly and detachability of the light sources without modifying the structure of the device and by proposing a modular assembly for lighting and suspension of hanging-rods.

SUMMARY OF THE INVENTION

In accordance with its principal characteristic feature, the present invention relates to a device for lighting and suspension of at least one hanging-rod, characterized in that it comprises a mounting member adapted to be fixed against a wall or a ceiling and at least a first sectional member constituting a cornice having in cross-section a vertical portion which forms at the upper end a cavity for hooking onto said mounting member and at the lower end a nose for receiving the raised end of a support which may be provided for a hanging-rod and for horizontal stabilization by means of a couple exerted between said mounting member and said hanging-rod support, and a portion having a horizontal tendency and of concave shape towards said upper end of the vertical portion and provided with first means for supplying electric current to at least a first light source, a proximal extremity of said horizontal-tendency portion being intended to constitute a vertical bearing surface for said raised end of the hanging-rod support.

Indications relating to position (horizontal, vertical, bottom, top, etc.) are given by considering the device in the position of use.

The shape of the cornice makes it possible in particular on the one hand to constitute a housing for the first electric current supply means and on the other hand, as will become apparent hereinafter, to contribute to the stabilization of said cornice on the mounting member, whether under the action of its own weight and the weight of the first light source or sources or by means of the hanging-rod.

According to a particularly advantageous secondary feature of the invention, said hanging-rod support has a cross-section in the shape of an "L", the base of which constitutes said raised end which cooperates with said reception nose and the branch of which constitutes a nut for a threaded upper end of the hanging-rod, said upper end being brought vertically into abutment with said mounting member at the time of attachment of said hanging-rod which thus has the effect of locking said support in a position in which said lower end of the vertical portion of the sectional member is subjected to a stabilization couple exerted between said mounting member and said support.

According to another advantageous feature of the invention for its use as a wall fixture, said mounting member has a cross-section in the shape of a "C", the vertical base of which is intended to be attached to a wall, a horizontal bottom branch of said mounting member being intended to constitute by means of its bottom face a vertical stop for said upper end of at least one hanging-rod and by means of its free extremity a horizontal stop for said reception nose, and a horizontal top branch of said mounting member being provided at its free end with an outwardly directed vertical extension on which is engaged said cavity for hooking-on said vertical portion of the cornice, the cavity formed by the two arms of the mounting member being intended to constitute an internal space for receiving the heads of means for attaching the mounting member to the wall.

Stabilization of the cornice on the mounting member is therefore ensured by virtue of the shape of the cornice by transfer of the weight of said cornice so that the hooking cavity is carried on the vertical extension of the mounting member, the extremity of the bottom branch of the mounting member being employed as a horizontal stop while being locked by the hanging-rod which, by means of the hanging-rod support, locks the cornice on the one hand vertically by bearing on the proximal extremity of its horizontal-tendency portion and on the other hand horizontally by means of the base of the support which is engaged in the reception nose.

According to a first embodiment of the invention for use as a ceiling fixture, said mounting member advantageously has a cross-section in the shape of a parallelepipedal tube, the two vertical walls of which each constitute a horizontal abutment for said reception nose of a cornice and are each provided with a top extension on which is engaged said hooking cavity of said vertical portion of the cornice and a bottom extension terminating in a horizontal extension towards the interior of the mounting member, the cavity formed by said vertical walls and horizontal walls which limit said tube being intended to constitute an internal space in which are housed means for attaching the mounting member to the ceiling.

Advantageously, said horizontal extension of said bottom extension of each vertical wall constitutes a vertical stop for the upper end of at least one hanging-rod which is associated with a cornice.

According to an alternative mode of utilization of the mounting member for ceiling attachment of this first embodiment, said bottom extensions and their respective horizontal extension define with a lower horizontal wall of the mounting member a cavity for receiving the upper end of a hanging-rod and a hanging-rod support plate, said lower horizontal wall being intended to constitute by means of its bottom face a vertical stop for said end of the hanging-rod.

According to a second embodiment of the invention for use as a ceiling fixture, said mounting member has a cross-section approximately in the shape of an "H" in which the lower portions of the branches each constitute a horizontal abutment for said reception nose of a cornice and are each provided substantially at the level of the cross-bar of the "H" with an inverted nose on which is engaged said hooking cavity of said vertical portion of the cornice, the upper portions of said branches being such as to delimit with said cross-bar an internal space in which are housed means for attaching the mounting member to the ceiling.

This second embodiment is found in accordance with the invention to be of very special interest for providing the possibility of direct lighting downwards from the mounting member.

To this end, said lower portions of the branches and said cross-bar of said mounting member delimit a cavity for housing at least a second light source and/or its attachment and electrical connection means, said second light source being associated with said mounting member, and said lower portions of said branches of said mounting member are each provided in the vicinity of its free end with means directed towards the interior of the mounting member for attaching a partition which serves to close said cavity, said partition being designed to allow the passage of luminous flux from a second light source housed within said cavity or to receive means for the attachment of second direct-lighting spotlight sources housed within said cavity or for the suspension and electrical connection of second direct-lighting spotlight sources suspended from said partition.

In this second embodiment, the mounting member usually represents a larger volume than the mounting member of the first embodiment for ceiling attachment insofar as it defines, in addition to the volume provided for receiving means for attachment of the mounting member to the ceiling, a cavity for housing at least a second light source associated with the mounting member.

According to the invention, the same type of cornice sectional member is employed whether for wall or ceiling attachment. Only the mounting member is of different structural design, especially in order to make it possible in the case of ceiling use to place two cornices with their vertical portions located in oppositely-facing relation, thus permitting either direct lighting of both faces of one and the same object or direct lighting of two objects placed back to back and suspended by means of either one or two hanging-rods or else direct lighting of the space located beneath the mounting member.

According to a particularly advantageous feature of the invention, said first electric current supply means include a rail of electrically insulating material in the top face of which are formed at least two open and parallel cylindrical housings for receiving at least two electric current supply leads, the lateral edges of said rail being intended to constitute tongues adapted to cooperate by snap-action engagement with bent-back retaining ribs formed on a top face of said horizontal-tendency portion of said cornice in the vicinity of a distal extremity of said vertical portion.

The device advantageously includes at least a first light source secured, possibly by means of a pivot, to a first end of at least one arm having a substantially parabolic shape which is downwardly concave in the position of use, a second end of said arm being rigidly fixed to a clamp for suspension and supply of electric current to said first light source, said clamp being intended to be engaged in the distal extremity of the cornice by being applied by complementary shape by means of a lower jaw against a bottom face of said horizontal-tendency portion whilst an upper jaw is applied by means of at least one spring-loaded electric current supply contact on one of said leads of said supply rail, said contact being electrically connected to a supply terminal of said first light source.

There is thus constituted an electric current supply line which is accessible for first light sources along the entire length of the cornice, thus permitting displacement at will and adaptation of these first light sources to the objects to be illuminated.

According to the invention, the first light sources can be constituted by point sources of the spotlight type or by longitudinal sources of the tube or shuttle type. Depending on the type of source, this latter will be suspended by means of one or a number of arms.

In the case of a spotlight suspended by means of a single arm, provision can be made in particular for an arrangement whereby the clamp associated with this arm is provided with two electric current supply contacts, each contact being intended to bear on one of the leads of the supply rail and whereby, in the case of a first source suspended by means of two arms, the clamp associated with each arm is provided with a single contact which is intended to bear on a single lead of the rail, the contact of a first clamp being applied on one of the two leads whilst the contact of a second clamp is applied on the other lead.

The parabolic shape of the arm and the fact that its concavity is directed downwards result in the fact that the transfer of the forces produced by the weight of the first light source to the vertical portion of the cornice does not counteract the stabilization of the cornice on the mounting member while permitting directional lighting towards an object suspended from the hanging-rod.

According to other features of the invention:

- the distal extremity of said horizontal-tendency portion of the cornice is substantially in the same horizontal plane as the upper end of said vertical portion of the cornice;
- the device includes at least one end-plate fixed on the edge face of one longitudinal end of said cornice;
- the device includes means for electrical connection of a third light source, said means being constituted by two socket connectors for an indirect-lighting luminous tube, each socket connector being fixed on one end-plate;
- said horizontal-tendency portion of the cornice has a longitudinal slot which is located directly beneath said luminous tube and on which is placed a translucent covering or an anti-glare grid in order to provide both direct and indirect lighting by means of said luminous tube which constitutes said third source;
- said first electric current supply means include in addition a voltage transformer which is intended to permit the supply of low voltage to said first and/or third light sources while being itself supplied with higher voltage by a cable from the exterior of the device, said cornice and mainly said horizontal-tendency portion being provided for this purpose on the internal or top face thereof with means for the horizontal support and position-maintenance of said transformer.

There is thus obtained a device which is readily adaptable to different modes of construction of the lighting system and of the suspension, starting from a single basic sectional member which constitutes the cornice.

A choice is offered in particular between direct lighting by a first light source at a distance from the cornice, direct lighting by a second light source housed within the mounting member and indirect and/or direct lighting by a third light source housed within the cornice while having the possibility of carrying out all combinations of these different forms of lighting.

Furthermore, the first light sources at a distance from the cornice can be chosen according to the desired form of lighting and are readily interchangeable.

The internal space defined by the cornice makes it possible in addition to integrate different elements therein for the purpose of concealing them from view, such as transformers, supply rail, third light source.

A device of this type also offers the advantage of permitting the association of a number of cornices for the construction of a modular assembly for lighting and suspension of hanging-rods.

The invention also relates to a modular assembly for lighting and suspension of hanging-rods which associates a plurality of sectional members constituting the cornice one after another in succession.

In order to permit correct alignment of these sectional members, these members are provided on their internal face with coupling means adapted to align the sectional members one after another in succession.

Advantageously, said coupling means are constituted by a bore formed in each end-plate of two adjacent sectional members in which is engaged a fishplate adapted to ensure coupling and alignment of the two sectional members.

According to other advantageous features of the invention:

said electric current supply rail is common to a number of sectional members placed one after another in succession;

the assembly includes in addition corner-connection sectional members adapted to couple two rectilinear sectional members, said coupling sectional members being similar in design to the rectilinear sectional members.

Provision is preferably made for different types of coupling sectional members according to the angle to be formed.

In the description of the invention which has been given above and which follows below, we have described the different parts which are associated with the cornice by means of the cross-sectional shape of the sectional member since it is easier in practice to provide the different noses, retaining ribs and so on in the form of a sectional member. However, it is equally possible to consider the construction of certain elements in the form of interrupted sections such as for example the snap-fastening ribs of the power supply rail, the means for supporting and securing the transformer, the means for snap-fastening of the connecting components. Similarly, the mounting member could be interrupted at certain locations.

There will be described hereinafter in greater detail a particular embodiment of the invention which will serve to gain a more complete understanding of its essential features and advantages although it should be understood that this embodiment is chosen by way of example and not in any limiting sense. This description is illustrated in the accompanying drawings.

BRIEF DESCRIPTION OF THE DRAWINGS

For reasons of clarity, the same elements have been designated by the same references in the different figures.

DETAILED DESCRIPTION OF THE INVENTION

Figure 1:
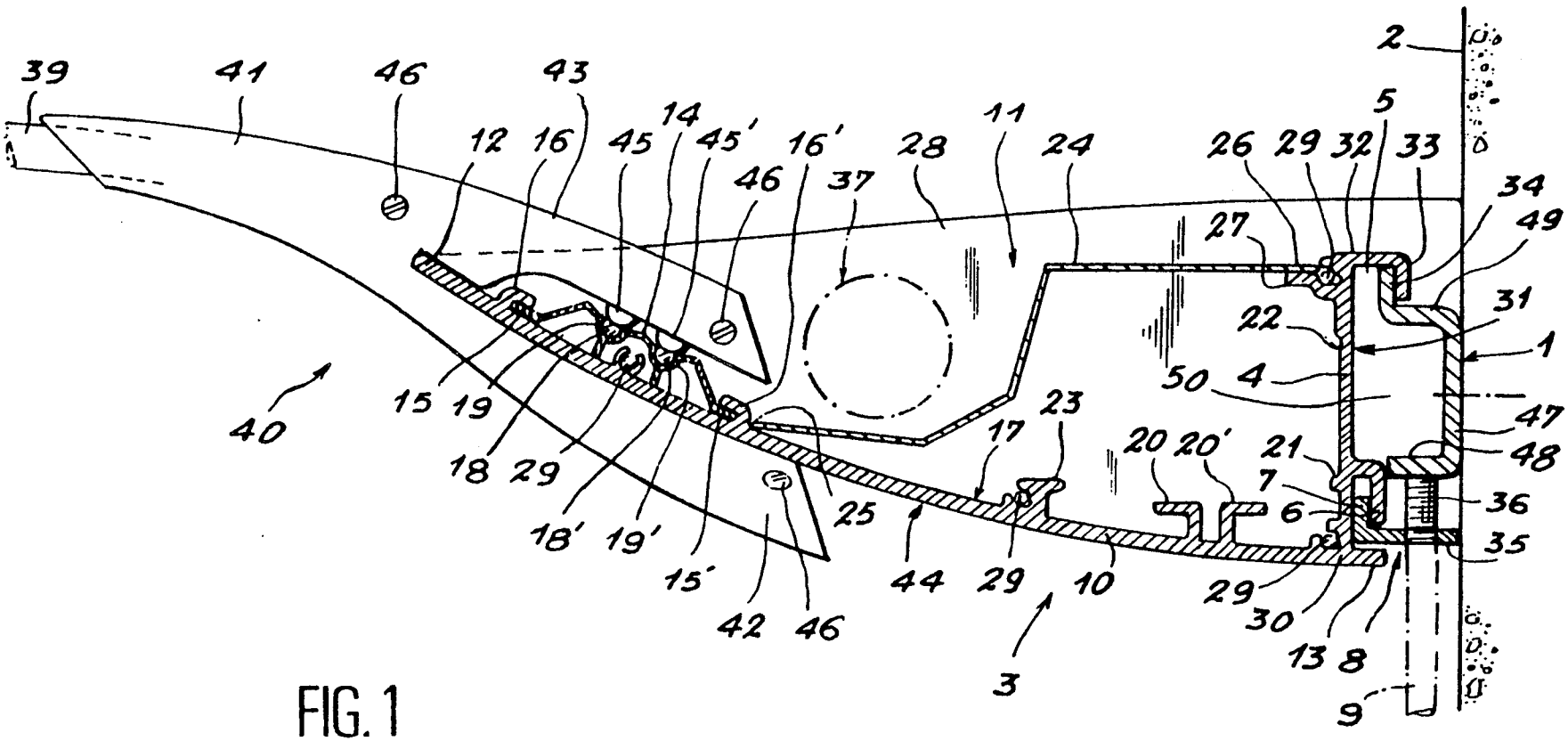
FIG. 1 is a transverse sectional view of a device in accordance with the invention which is fitted with a mounting member for wall attachment.

The device for lighting and suspension of a hanging-rod as illustrated in FIG. t comprises a shaped mounting member 1 which is intended to be fixed by known means of a suitable type (not illustrated) on a vertical face or wall 2 and a first sectional member 3 constituting a cornice designed to receive or to suspend a first light source.

The cornice 3 is essentially constituted by a vertical portion 4 forming at the upper end a cavity 5 for hooking onto the mounting member 1 and at the lower end a nose 6 for receiving the raised end 7 of a support 8 for a hanging-rod 9 and by a portion 10 having a horizontal tendency.

The horizontal-tendency portion 10 of the cornice 3 has a concave shape towards the upper end of the vertical portion 4 and defines therewith an internal space 11 of the cornice 3.

One extremity 12 of the horizontal-tendency portion 10 which is distal from the vertical portion 4 is approximately aligned horizontally with the top end of said portion 4 whilst a proximal extremity 13 extends towards the mounting member 1 beyond the vertical portion 4 so as to constitute a vertical bearing surface for the raised end 7 of the hanging-rod support 8.

The device also includes first electric current supply means consisting in particular of a rail 14 of electrically insulating material fixed by snap-action engagement of two tongues 15, 15' constituting its lateral edges in bent-back retaining ribs 16, 16' which project from the top or internal face 17 of the horizontal-tendency portion 10 of the cornice 3 in the vicinity of its distal extremity 12.

The rail 14 forms in its top face two cylindrical housings 18 and 18' which open in the upward direction and are each intended to receive an electric current supply lead 19, 19' both leads 19 and 19' being connected to a current source (not shown) by suitable means.

The first supply means preferably include in addition a supply transformer (not shown) for delivering a low voltage (12 volts, for example) to the leads 19 and 19' from the line supply voltage.

In order to mount this transformer within the cornice 3, said cornice is provided with two supports 20 and 20' which project from the internal face 17 of the horizontal-tendency portion 10 in the vicinity of its proximal extremity 13 and define a horizontal surface on which the transformer base is intended to rest. In conjunction with a first lug 21 which projects from an internal face 22 of the vertical portion 4 at the lower end thereof and with a second lug 23 which projects from the internal face 17, the above-mentioned supports 20 and 20' constitute means for the horizontal support and position-maintenance of the transformer, the lug 21 and the lug 23 being intended to retain the transformer vertically by means of the edges of its base which rests on the supports 20 and 20'.

With a view to protecting the transformer and any electrical connections from dust and to preventing any untimely access thereto, provision is made for a shaped cover 24, one lateral edge 25 of which rests on the horizontal-tendency portion 10 while being abuttingly applied against the retaining rib 16' which is located innermost within the internal space 11. The other lateral edge 26 of said cover rests on a supporting lug 27 which projects from the internal face 22 of the upper end of the vertical portion 4, the cover 24 being attached to said supporting lug 27 by any known means of a suitable type (not shown in the drawings).

The cornice 3 is completed at its longitudinal ends by end-plates 28 which are held in position by snap-fastening means or by screws. Said snap-fastening means can consist of four substantially cylindrical open grooves 29 which project towards the interior of the cornice 3 and are formed at the intersection 30 between the vertical portion 4 and the horizontal-tendency portion 10, at the upper end of the vertical portion 4 at the level of the supporting lug 27, as a projection from the internal face 17 of the horizontal-tendency portion 10 at the level of the lug 23, and as a projection from the internal face 17 of the horizontal-tendency portion 10 between the two ribs 16 and 16' provided for the power supply rail 14. In the event that the end-plates are secured by means of screws, provision is preferably made for self-tapping screws which are intended to be screwed into said grooves 29.

For the purpose of securing the cornice 3 to the mounting member 1, the vertical portion 10 is provided on the one hand, at the upper end thereof, with a horizontal extension 32 which projects from an external face 31 towards the mounting member 1 and terminates in a downward vertical extension 33 defining the hooking cavity 5 which is adapted to receive a vertical extension 34 of the mounting member 1 and on the other hand, at the lower end thereof, with the nose 6 for receiving the hanging-rod support 8.

Said hanging-rod support 8 is constituted by a member having a cross-section in the shape of an "L", the base 7 of which constitutes the raised end received by the nose 6 and rests at the level of its intersection with the branch 35 on the proximal extremity 13 of the horizontal-tendency portion 10 of the cornice 3. The base 7 is engaged within the open cavity delimited by the nose 6 and the proximal extremity 13 by presenting the free end of the base in front of the opening and then swinging the support downwards in order to insert the base 7 in the reception nose 6.

The branch 35 of the hanging-rod support 8 has a threaded through-hole so as to constitute a nut which is intended to receive a threaded upper end 36 of the hanging-rod 9. When it is screwed through the branch 35, said upper end 36 is abuttingly applied against the bottom face of the mounting member 1 so as to have the effect of locking the hanging-rod support 8 in a position in which the lower end of the vertical portion 4 is subjected to a stabilization couple exerted between the mounting member 1 and the hanging-rod support 8.

The hanging-rod 9 thus suspended is preferably intended to fasten objects to be exhibited and to be illuminated by a first light source which will be described hereinafter.

The device comprises means adapted to permit either indirect or direct lighting or a combination of both modes of lighting.

In the case of indirect lighting, it is intended that the two end-plates 28 which limit a cornice 3 should each be provided on their internal face with a socket (not shown) for electrical connection and holding in position of a tube 37 or shuttle of the neon type, incandescent type, halogen type or the like which constitutes a third light source and the light rays of which are directed upwards on account of the screen formed by the cornice 3, the cover 24 being preferably designed to contribute to the reflection of light rays. Depending on the types of lighting desired, provision can also be made for the attachment of connecting and holding sockets to the internal face of the cornice 3.

Steps can be taken to associate a third light source of this type with direct lighting by forming an elongated slot (not shown in the drawings) in the horizontal-tendency portion 10 of the cornice 3, between the retaining rib 16' and the lug 23, a translucent covering or an anti-glare grid being placed over said slot.

In a preferred embodiment of the invention which is intended to constitute a direct-lighting system, the device includes a first light source 38 (FIG. 7, 8) suspended at a distance from the cornice 3 by attachment to a first end of an arm 39, a second end of said arm being connected to a suspension and supply clamp 40.

Said clamp 40 is constituted (FIG. 1) by a body 41 provided with means for securing the arm 39 and with two jaws 42 and 43 which are intended to clamp the distal extremity 12 of the horizontal-tendency portion 10 of the cornice 3.

A lower jaw 42 is applied by complementary shape of its inner or top face against an outer face 44 of the horizontal-tendency portion 10 of the cornice 3 and an upper jaw 43 is applied on the one hand in the region of its junction with the body 41, by complementary shape against the distal extremity 12 of the inner face 17 of the horizontal-tendency portion 10 of the cornice 3 and on the other hand against the leads 19 and 19' carried by the rail 14, by means of two spring-loaded contacts 45 and 45' which project from the inner or bottom face of the upper jaw 43.

In practice, the clamp 41 is constructed by means of two molded shells each defining a half-body, a lower half-jaw and an upper half-jaw and assembled together by means of screws 46 after introduction of the spring-loaded contacts 45 and 45' of the end of the arm 39 and of leads (not shown) which provide an electrical connection between the first light source 38 and the contacts 45 and 45' and pass inside the arm 39.

In the embodiment shown in FIG. 1, the mounting member 1 of the device is intended to be attached to a wall 2 or to a vertical surface.

To this end, the mounting member 1 has a C-shaped cross-section and has a vertical base 47 provided with holes (not shown) through which are passed suitable means such as fixing screws, for example, for securing the mounting member to the wall 2. A horizontal bottom branch 48 of said mounting member constitutes by means of its outer or bottom face the vertical stop for the upper end 36 of the hanging-rod 9 and constitutes by means of its free extremity a horizontal stop for the nose 6 which serves to receive the hanging-rod support 8. A horizontal top branch 49 of said mounting member is provided at its free end with an upwardly directed vertical extension 34 on which is engaged the hooking cavity 5 of the cornice 3.

The internal space 50 defined by the mounting member 1 constitutes a space for receiving the heads of the screws employed for securing the mounting member 1 to the wall 2.

Figure 2:
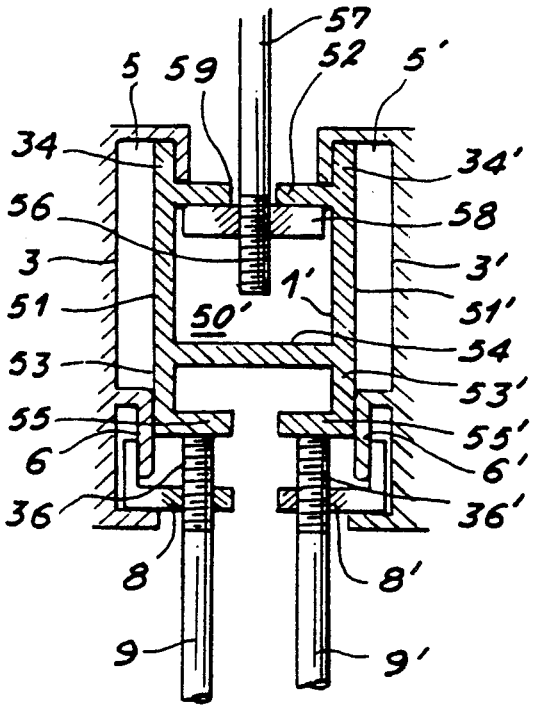
FIG. 2 is a transverse sectional view of a first embodiment of a mounting member in accordance with the invention for attachment to the ceiling.

FIG. 2 illustrates a first embodiment of a mounting member 1' for attachment of the device beneath a ceiling (not shown) and for the purpose of hooking-on two cornices 3 and 3' placed back to back.

Said mounting member 1' has a cross-section in the shape of a parallelepipedal tube, two vertical walls 51, 51' of which each constitute at the lower end thereof a horizontal abutment for the nose 6 or 6' which is associated with a cornice 3 or 3' and terminate at the upper end thereof in a vertical extension 34 or 34' which extends vertically above a top horizontal wall 52, the hooking cavity 5 or 5' which is associated with the cornice 3 or 3' being intended to engage on said extension.

The vertical walls 51 and 51' are each provided at the lower end thereof with a vertical extension 53 or 53' which extends below a bottom horizontal wall 54 and terminate in a horizontal extension 55 or 55' which is directed towards the interior of the mounting member 1' and constitutes a vertical stop for the upper end 36 or 36' of a hanging-rod 9 or 9' associated with the cornice 3 or 3' from which it is suspended by means of a hanging-rod support 8 or 8'.

The cavity delimited by the horizontal walls 52 and 54 and the vertical walls 51 and 51' constitutes an internal space 50' for receiving threaded ends 56 of suspension elements 57 which are attached to the ceiling by any suitable means of known type (not illustrated) and internally threaded plates 58 into which the end 56 of an associated suspension element 57 is screwed so as to ensure rigidity of the mounting member 1'. Preference is given to the use of internally threaded plates 58 rather than nuts in order to permit rotational locking of the plates 58 by means of vertical walls 51 and 51' and thus to facilitate attachment of the mounting member 1' to the ceiling by means of the suspension elements 57. The internal space 50' also permits height adjustment of the position of the mounting member 1' as a function of the depth to which the ends 56 of the suspension elements 57 are screwed.

The mounting member 1' is therefore attached to the ceiling while being virtually suspended by means of the suspension elements 57 and the length of the suspension elements 57 defines the distance between the ceiling and the device within the range of height adjustment permitted by the internal space 50'. Care should be taken to ensure that, once the mounting member 1' has been secured, the above-mentioned distance is sufficient to permit hooking-on of the cornices 3 and 3' and therefore to pass them over their respective hooking cavity 5 and 5'.

The upper horizontal wall 52 is provided with a longitudinal slot 59 through which are passed the ends 56 of the suspension elements 57 for attachment of the mounting member 1'. Said wall 52 could be provided with uniformly distributed through-holes but it will be found preferable to form the above-mentioned longitudinal slot 59 as a top opening of the internal space 50' so as to permit horizontal adjustment of the position of the mounting member 1'.

Figure 3:
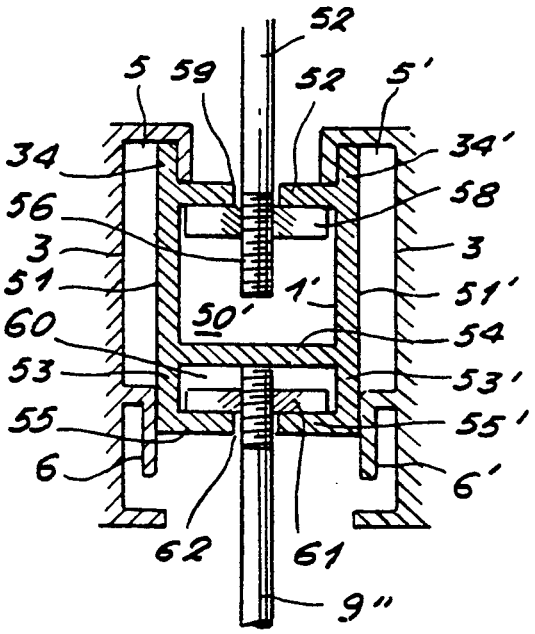
FIG. 3 is a transverse sectional view of an alternative mode of utilization of the mounting member for ceiling attachment as shown in FIG. 2.

In an alternative mode of utilization of a mounting member 1' for attachment to a ceiling as shown in FIG. 3, this mounting member is similar in shape to the representation of FIG. 2 but is employed for the suspension of a hanging-rod 9" directly from the mounting member 1'. To this end, advantageous use is made of the cavity 60 delimited by the lower horizontal wall 54, the extensions 53 and 53' and their respective extension 55 and 55', which constitutes a cavity for receiving the upper end 36" of the hanging-rod 9" and an internally-threaded hanging-rod support plate 61. Said upper end 36" is screwed into said support plate and passes through a slot 62 defined by the distance between the horizontal extensions 55 and 55'. The bottom face of the lower horizontal wall 54 accordingly constitutes a vertical stop for the end portion 36" of the hanging-rod 9". For the same reasons as those set forth for the attachment of the mounting member 1' to the suspension element 57, an internally threaded plate 61 is again employed rather than a nut.

Figure 4:
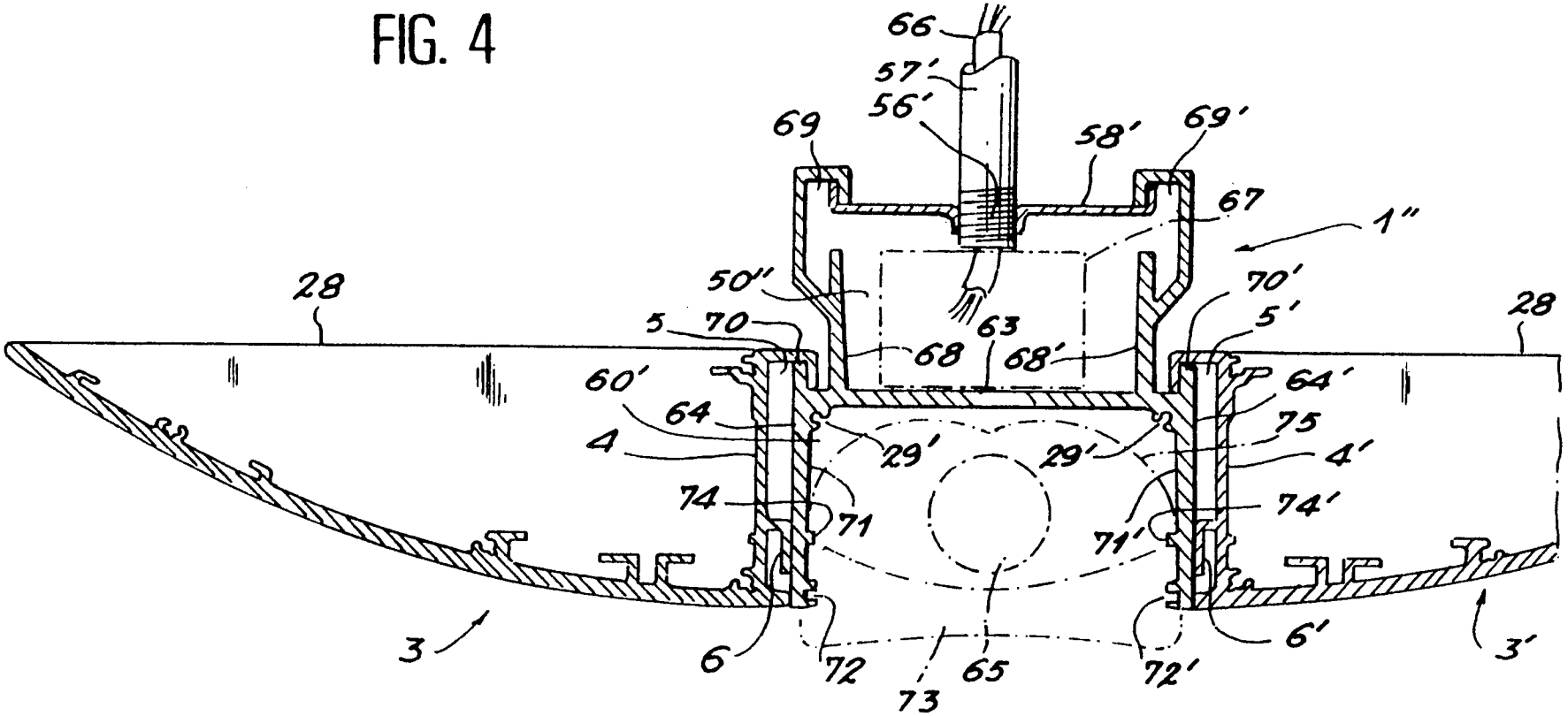
FIG. 4 shows partially and in transverse cross-section a device in accordance with the invention which is fitted with a mounting member for ceiling attachment in accordance with a second preferred embodiment.

FIG. 4 illustrates a second preferred embodiment of a mounting member 1" which serves to attach the device beneath a ceiling (not shown) and permits hooking-on of two cornices 3 and 3' placed back to back.

The cornices 3 and 3' have already been described with reference to FIG. 1. All their components are therefore not reproduced in FIG. 4 for reasons of clarity.

The mounting member 1" has an approximately H-shaped cross-section. The cross-bar 63 of the H divides the space between the two branches 64 and 64' of the "H" into an internal space 50" having the function of receiving means for attaching the mounting member 1" to the ceiling and a cavity 60' which serves to receive a second direct-lighting light source 65 or its attachment and/or connection means.

The means for attaching the mounting member 1" to the ceiling consist of suspension elements 57' attached to the ceiling by any known means of a suitable type (not shown), a threaded end 56' of which is screwed into a stirrup-piece 58' providing a connection with the mounting member 1".

The suspension elements 57' are preferably designed in the form of cylindrical tubes, thus making it possible to pass through at least one of said tubes a cable 66 for the supply of electric current to the second light source 65, if necessary via a transformer or an electrical equipment unit 67 adapted to the second light source 65 and housed within the internal space 50" which accommodates the means (56', 57', 58') for attaching the mounting member 1" to the ceiling.

The branches 64 and 64' of the mounting member 1" are each provided in the vicinity of the free end of their upper portion 68, 68' with a housing 69, 69' for receiving one end of the connecting stirrup-pieces 58', said housing being open towards the interior of the space 50". Each branch is also provided substantially at the level of the cross-bar 63 of the H section with an inverted nose 70, 70' on which is engaged the hooking cavity 5 or 5' of the vertical portion 4 or 4' of the cornice 3 or 3' with which the branch 64 or 64' of the mounting member 1" is associated.

The lower portions 71 and 71' of the branches 64 and 64' each constitute a horizontal abutment for the reception nose 6 or 6' of the cornice 3 or 3' with which it is associated.

Said lower portions serve to define with the cross-bar 63 the cavity 60' which accommodates the second light source 65.

Substantially cylindrical open grooves 29' constituting means for snap-fastening or reception of screws for securing end-plates (not shown) which close the H section at its longitudinal extremities are formed at the intersection of the branches 64 and 64' with the cross-bar 63, towards the interior of the mounting member 1''. The end-plates can be designed in one piece so as to close the longitudinal extremities both of the cornices 3 and 3' and of the mounting member 1''.

The free ends of the lower portions 71 and 71' of the branches 64 and 64' of the mounting member 1'' 15 comprise means 72 which project towards the interior of the mounting member 1'' and serve to attach a partition 73 for closing the cavity 60'.

The second light source shown in FIG. 4 consists of a tube 65 or a shuttle of the neon type, 20 incandescent type, halogen type or the like and housed within the cavity 60' in which it is held in position and supplied with electric current by suitable means (not shown). The partition 73 in this case is preferably constituted by a translucent plate or by an anti-glare grid. The lower portions 71 and 71' of the branches 64 and 64' are provided with lugs 74 and 74' which project towards the interior of the mounting member 1'', said lugs being intended to support an optical system 75 for downward reflection of the light rays of the tube 65.

Figure 5:
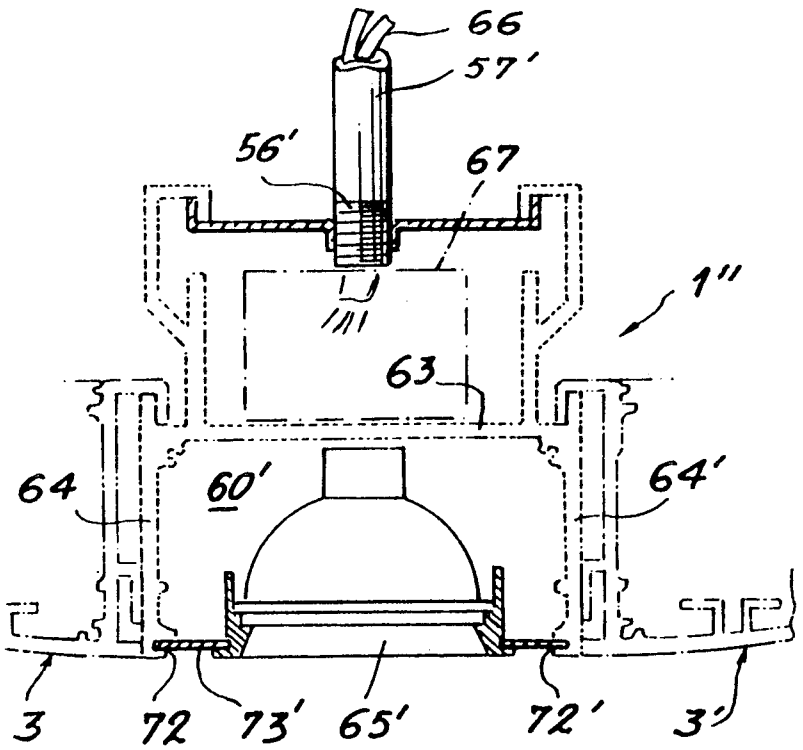

FIG. 5 shows an alternative mode of utilization of the mounting member 1'' illustrated in FIG. 4, in which second point sources of light 65' of the spotlight type are inserted in the cavity 60' of the mounting member 1'' while being supported by a plate 73' constituting the partition which closes the cavity 60'.

Figure 6:
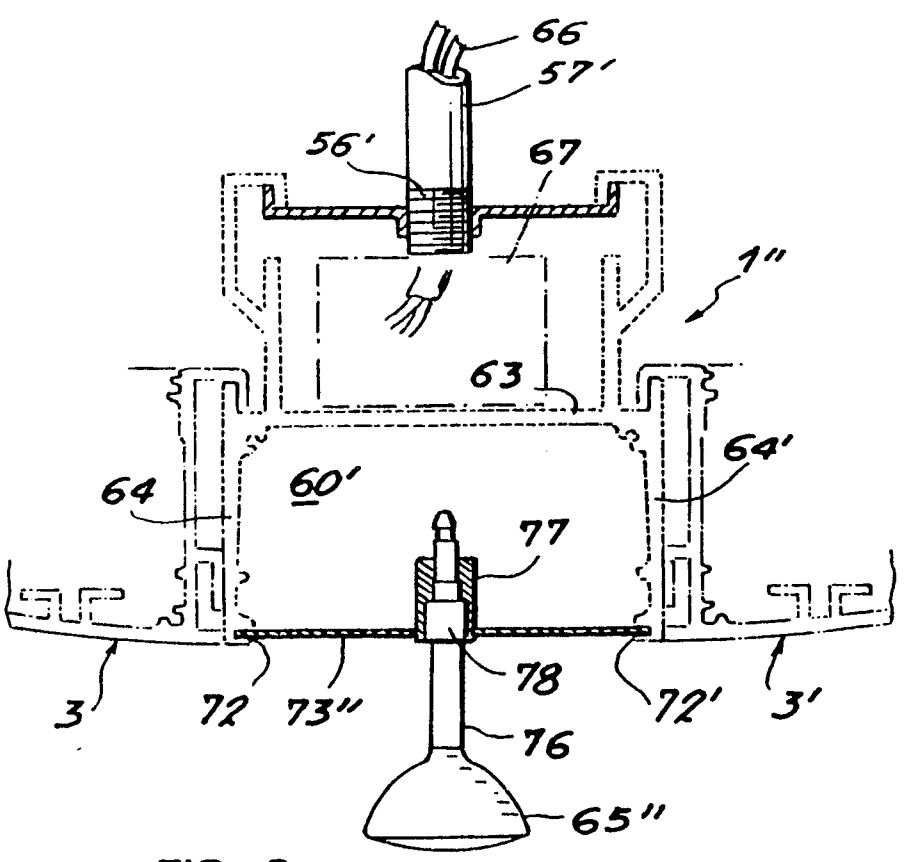
FIGS. 5 and 6 show in transverse cross-section alternative modes of utilization of the mounting member for ceiling attachment as illustrated in FIG. 4.

FIG. 6 shows another alternative mode of utilization of the mounting member 1'' illustrated in FIG. 4, in which second point sources of light 65'' of the spotlight type are suspended by means of rods 76 from a plate 73' which receives the means for attachment and electrical connection of the sources 65'' to the mounting member 1''. These attachment and electrical connection means preferably consist of female socket connectors 77 which are each intended to receive a male plug 78 fixed at the free end of the rod 76 for suspension of a source 65'', the rod being hollow so that leads (not shown) can be passed through in order to supply electric current to the source 65'' which is suspended by means of said rod.

For reasons of clarity of the drawings, the electrical connections between the light sources and the power supply system are not illustrated. These connections are made in accordance with conventional practice by means of lead wires which may be so arranged as to pass through the walls of the mounting member or of the cornice or cornices.

The mounting member 1'' may also be employed for the suspension of hanging-rods 9'' of the type illustrated in FIG. 3 and may be associated if so required with the use of second light sources, in which case the partition 73' or 73'' is so designed as to be capable of receiving the threaded end of the hanging-rods 9''.

Figure 7:
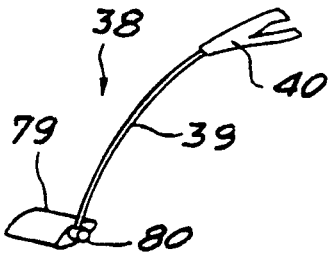
FIGS. 7 and 8 show in perspective two preferred embodiments of first light sources in accordance with the invention.
Figure 8:
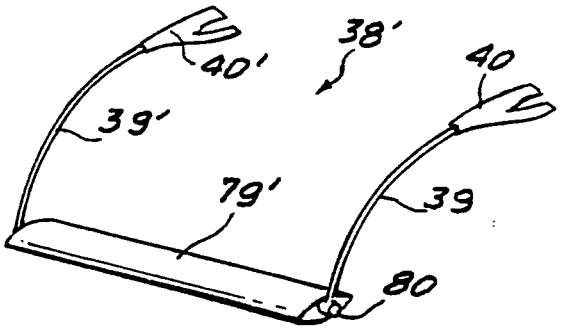

FIGS. 7 and 8 show two examples of construction of first light sources to be suspended from a cornice 3.

FIG. 7 shows a first point source of light 38 of the spotlight type. The constructional design of this first source will be described only in regard to those elements which are essential to a clear description of the invention.

The casing 79 of the first source 38 is connected to a first extremity of an arm 39 by means of a pivot 80 which permits orientation of the arm with respect to the pivot.

The arm 39 is preferably of parabolic shape with a downwardly directed concavity and is connected by a second extremity to a clamp 40, already described with reference to FIG. 1.

FIG. 8 shows a first light source 38' of the shuttle or tube type. The casing 79' is connected at each longitudinal extremity, again by means of pivots, to an arm 39 or 39'.

The clamps 40 and 40' associated with the arms 39 and 39' can each be provided with a single spring-loaded contact 45 or 45' (FIG. 1) so as to establish an electrical connection between the cornice 3 and the first source by passing through one of the two arms on the outgoing path and through the other arm on the return path.

Figure 9:
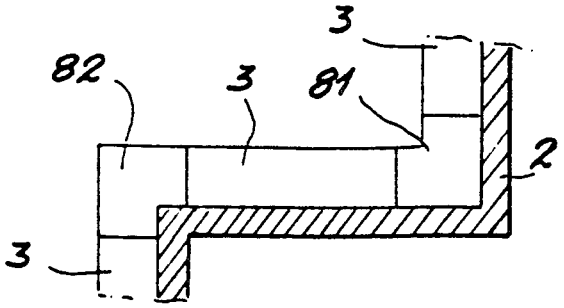
FIG. 9 is a diagrammatic top view showing one example of construction of an assembly in accordance with the invention.

FIG. 9 shows diagrammatically an assembly for lighting and suspension of hanging-rods in which corner-connection sectional members are employed.

In this figure, there is shown a first rectilinear cornice element 3 which is connected on one side to a second cornice element 3 by means of a corner-connection sectional member 81 in order to follow an angle of 90° formed by the wall 2 and on the other side to a third cornice element 3 by means of a corner-connection sectional member 82 in order to follow an angle of 270° formed by the wall 2.

Although sectional members providing right-angled connections have been illustrated in the figure, any other angle can of course be obtained by means of a suitable connecting member, these corner-connection sectional members being similar in design to the cornices 3.

In order to ensure alignment of the rectilinear cornice elements 3 with the connecting sectional members 81, 82 or with other rectilinear elements placed end to end, the horizontal-tendency portion 10 of the rectilinear sectional members 3 or connecting sectional members 81, 82 is provided with means which serve to snap-fasten connecting components (not shown) and which project from the inner face of said portion 10. By way of example, said snap-fastening means can be constituted by the cylindrical grooves 29 in which are engaged connecting components consisting of full cylindrical sections of small size while ensuring alignment of two adjacent sectional members.

Especially in the preferential event of formation of cornice modules each provided with two end-plates, provision can also be made approximately at the center of said end-plates for a bore which is intended to receive a fishplate for coupling and alignment of two adjacent modules.

In the case of an assembly which is attached to a ceiling, said bore can also serve to receive a fixing screw for a decorative end element which covers the end-plate of both cornices 3 and 3' and closes-off the end of the mounting member 1' or 1''.

The invention therefore makes it possible to construct a modular lighting unit which, starting from one and the same cornice 3, permits a large number of variations in the construction of the assembly for lighting and suspension of hanging-rods, whether it is mounted against a wall or beneath a ceiling. Furthermore, in the case of attachment to a ceiling, the invention again makes it possible by using one and the same mounting member 1'' as a starting element to obtain a large number of variations of the assembly for lighting and suspension of hanging-rods. The structural design thus permitted by the invention is such that the assembly for lighting and suspension of hanging-rods has a convenient modular character which is particularly evolutionary.

It is naturally apparent that the invention is not limited in any sense to the particular features specified in the foregoing or to the details of the particular embodiments which have been chosen in order to illustrate the invention. All kinds of alternative arrangements may be made in the particular embodiments which have been described by way of example and in their constituent elements without thereby departing from the scope of the invention. Accordingly, the invention includes all means which constitute technical equivalents to the means described as well as their combinations.

What is claimed is:

1. Device for lighting and suspension of at least one hanging-rod (9; 9'; 9''), wherein said device comprises a mounting member (1; 1'; 1''), a first sectional member (3; 3') having in cross-section a vertical portion (4; 4') having an upper end formed with means for hooking (5; 5') onto said mounting member (6; 6') for receiving the raised end (7) of a support, and a horizontally extending portion (10) of upward facing concave shape and provided with first means for supplying electric current to at least a first light source (38; 38') and having a proximal extremity (13) adjacent to said hooked projection and constituting a vertical bearing surface.

2. Device according to claim 1, further comprising a hanging-rod support (8; 8') having a cross-section in the shape of an "L", a raised end (7) which cooperates with said projection (6; 6') and a branch (35) which constitutes a nut for a threaded upper end (36; 36') of a hanging-rod (9; 9'), said upper end being brought vertically into abutment with said mounting member (1; 1'; 1'') at the time of attachment of said hanging-rod (9; 9') which thus has the effect of locking said support (8; 8') in a position in which said lower end of the vertical portion (4; 4') of the sectional member (3; 3') is subjected to a stabilization couple exerted between said mounting member (1; 1'; 1'') and said support (8; 8').

3. Device according to claim 2, wherein said mounting member (1) has a cross-section in the shape of a "C", a vertical base (47) which is intended to be attached to a wall (2), a horizontal bottom branch (48) having a bottom face constituting a vertical stop for said upper end (36) of said at least one hanging-rod (9) and a free extremity constituting a horizontal stop for said projection (6), and a horizontal top branch (49) having a free end with an outwardly directed vertical extension (34) on which is engaged said means for hooking (5), a cavity (50) formed by the two branches of the mounting member (1) constituting an internal space in which are housed means for attaching the mounting member (1) to the wall (2).

4. Device according to claim 1, wherein said mounting member (1') has a cross-section in the shape of a parallelepipedal tube, the two vertical walls (51; 51') of which each constitute a horizontal abutment for said projection (6; 6') and are each provided with a top extension (34; 34') on which is engaged said hooking means (5; 5') of said vertical portion of the member (3; 3') and a bottom extension (53; 53') terminating in a horizontal extension (55; 55') towards the interior of the mounting member (1'), a cavity (50') formed by said vertical walls (51; 51') and horizontal walls (52; 54) which limit said tube constituting an internal space for receiving means (56, 57, 58) for attaching the mounting member (1') to the ceiling.

5. Device according to claim 4, wherein said horizontal extension (55; 55') of said bottom extension (53; 53') of each vertical wall (51; 51') constitutes a vertical stop for the upper end (36; 36') of at least one hanging-rod (9; 9') associated with the member (3; 3')

6. Device according to claim 4, wherein said bottom extensions (53; 53') and their respective horizontal extension (55, 55') define with a lower horizontal wall (54) of the mounting member (1') a cavity (60) for receiving the upper end (36'') of a hanging-rod (9'') and a hanging-rod support plate (61), said lower horizontal wall (54) having a bottom face constituting a vertical stop for said end (36'') of the hanging-rod (9'').

7. Device according to claim 1, wherein said mounting member (1'') has a cross-section approximately in the shape of an "H", lower branches (71; 71') each constituting an abutment for said projection (6; 6'), a cross-bar (63) of the "H" having vertical projections (70; 70') on which is engaged said hooking means (5; 5') of said vertical portion (4; 4') of the member (3; 3'), and upper branches (68; 68') defining with said cross-bar (63) an internal space (50'') in which are housed means (56', 57', 58') for attaching the mounting member (1'') to the ceiling.

8. Device according to claim 7, wherein said lower branches (71, 71') and said cross-bar (63) of said mounting member (1'') define a cavity (60') for housing at least a second light source (65; 65'; 65'') associated with said mounting member (1'').

9. Device according to claim 8, wherein said lower branches (71; 71') each have a free end provided with means (72) directed towards the interior of the mounting member (1'') for attaching a partition (73; 73', 73'') which serves to close said cavity (60').

10. Device according to claim 1, wherein said first electric current supply means include a rail (14) of electrically insulating material having a top face formed with at least two open and parallel channels (18, 18') for receiving at least two electric current supply leads (19, 19'), the rail having lateral edges (15, 15') adapted to cooperate by snap-action engagement with bent-back retaining ribs (16, 16') formed on a top face (17) of said horizontally extending portion (10) of said member (3; 3').

11. Device according to claim 10, wherein said device comprises at least a first light source (38; 38') secured to a first end of at least one arm (39; 39') having a substantially parabolic shape which is downwardly concave in the position of use, a second end of said arm being rigidly fixed to a clamp (40; 40') for suspension and supply of electric current to said first light source (38; 38'), said clamp (40; 40') being profiled to engage a distal extremity (12) of the first sectional member (3; 3') by means of a lower jaw (42) applied against a bottom face (44) of said horizontally extending portion (1) and an upper jaw (43) applied by means of at least one spring-loaded electric current supply contact (45; 45') on one of said leads (19; 19') of said supply rail (14), said contact (45; 45') being electrically connected to a supply terminal of said first light source (38; 38').

12. Device according to claim 1, wherein the horizontally extending portion has a distal extremity (12)

substantially in the same horizontal plane as the upper end of said vertical portion (4; 4') of the member (3; 3').

13. Device according to claim 1, wherein said device includes at least one end-plate (28) fixed on said member (3; 3').

14. Device according to claim 13, wherein said device includes means for electrical connection of a third light source (37), said means being constituted by two socket connectors for an indirect-lighting luminous tube (37), each socket connector being fixed on one end-plate (28).

15. Device according to claim 14, wherein said horizontally extending portion (10) of the first sectional member (3; 3') has a longitudinal slot which is located directly beneath said third light source (37) and on which is placed a translucent covering in order to provide both direct and indirect lighting by means of said third light source (37).

16. Device according to claim 1, wherein said first electric current supply means include in additional voltage transformer which is intended to permit the supply of low voltage to at least one of said first and third light sources (37; 38; 38') while being itself supplied with higher voltage by a cable from the exterior of the device said horizontally extending portion (10) being provided with means for the horizontal support and position-maintenance of said transformer.

17. Modular assembly for lighting and suspension of hanging-rods, wherein said assembly comprises at least two said first sectional members (3) according to claim 1 and wherein said first sectional members (3) each have an internal face (17) provided with coupling means adapted to align the first sectional members (3) one after another in succession.

18. Assembly according to claim 17, wherein the coupling means are constituted by a bore formed in each end-plate (28) of two adjacent sectional members in which is engaged a fishplate adapted to ensure coupling and alignment of the two sectional members (3).

19. Assembly according to claim 17 further comprising an electric current supply rail (14) which is common to said sectional members (3) placed one after another in succession.

20. Assembly according to claim 17 wherein said assembly comprises in addition corner connection sectional members (81; 82) adapted to couple two said first sectional members (3) placed together at a 90 degree angle.

* * * * *

UNITED STATES PATENT AND TRADEMARK OFFICE

CERTIFICATE OF CORRECTION

PATENT NO. : 5,331,526

DATED : July 19, 1994

INVENTOR(S) : Alain Girot et al

It is certified that error appears in the above-indentified patent and that said Letters Patent is hereby corrected as shown below:

Column 13, line 26, after "mounting member" insert --(1; 1'; 1"), a lower end formed with a hooked projection--.

Signed and Sealed this

Seventh Day of March, 1995

Bruce Lehman

*Attest:*

BRUCE LEHMAN

*Attesting Officer*

*Commissioner of Patents and Trademarks*